US005095862A

United States Patent [19]

Murphy

[11] Patent Number: 5,095,862

[45] Date of Patent: Mar. 17, 1992

[54] REMOVABLE ADJUSTABLE PUSHROD

[75] Inventor: Martin Murphy, Shirley, N.Y.

[73] Assignee: Ram Pushrods, Inc.

[21] Appl. No.: 688,294

[22] Filed: Apr. 22, 1991

[51] Int. Cl.[5] ..... F01L 1/14

[52] U.S. Cl. ..... 123/90.61

[58] Field of Search ..... 123/90.61, 90.62, 90.63, 123/90.64

[56] References Cited

U.S. PATENT DOCUMENTS

| | | | |
|---|---|---|---|
| 1,443,940 | 2/1923 | Anderson | 123/90.62 |
| 1,613,346 | 1/1927 | Davis | 123/90.61 |
| 2,053,743 | 9/1936 | Russell | 123/90.61 |
| 2,067,114 | 1/1937 | Ashton | 123/90.61 |
| 4,589,384 | 5/1986 | Ott | 123/90.61 |
| 4,602,597 | 7/1986 | Rhoads | 123/90.63 |

*Primary Examiner*—E. Rollins Cross
*Assistant Examiner*—Weilun Lo
*Attorney, Agent, or Firm*—Alfred M. Walker

[57] ABSTRACT

The pushrod incorporates an upper threaded retractable section which enables the technician to shorten the pushrod to nine inches. At the shortened length, the pushrods can be removed from the side of the engine without dismantling the upper rocker box assembly, which would also enable the motorcycle repair technician to adjust the length of the pushrods to ensure proper and quiet hydraulic lifter operation.

3 Claims, 2 Drawing Sheets

REMOVABLE ADJUSTABLE PUSHROD

BACKGROUND OF THE INVENTION

The present invention relates to removable, adjustable pushrods designed especially for Harley Davidson Evolution® type motorcycle engines. The Evolution® engine is a two cylinder four stroke gasoline type motorcycle engine. Pushrods are rods which are used in the internal combustion components of a motorcycle engine. In a typical engine the pushrod is movably connected at one end to the rocker arm at the top of a typical motorcycle combustion engine at one end and movably connected at the other end to the hydraulic lifter within the tappet block. The pushrod is engageable at its bottom end with the hydraulic lifter. In a motorcycle engine such as the Evolution® type engine, mechanical power is transferred from the flywheel assembly to the pinion shaft and pinion gear to the cam shaft, which transfers mechanical power to the tappet roller and hydraulic lifter within the tappet block. Then the pushrod conveys power at its upper end to the rocker arm within the rocker box assembly at the top of the motorcycle engine.

In a typical Evolution® type motorcycle engine, there is a spatial gap between the bottom of the rocker arm assembly at the top of the engine, and the top of tappet block at the lower part of the engine.

The top of the pushrod is movably connected to the rocker arm, which is encased within the confines of the rocker box assembly. Furthermore, the lower end of the typical pushrod is movable within the confines of the tappet block, for engagement with the hydraulic lifter. Therefore, a significant portion of the pushrod at both the top and bottom end is unavailable for inspection and removal without first exhaustively removing the rocker box assembly from the cylinder head of the motorcycle engine. Although a portion of the pushrod assembly is exposed within the aforesaid spatial gap, the top and bottom portions within the rocker arm assembly and tappet block assembly are inaccessible.

The top of each pushrod extends approximately 1 inch into the rocker box assembly where the top is engageable with the rocker arms which open and close the valves of the engine and extends approximately 1 inch into tappet block at bottom end of pushrod.

Typical original equipment manufactured Evolution® motorcycle engines utilize four pushrods constructed of approximately ⅜ inch hollow tubing with ⅜ inch hardened steel balls at each end for engagement with the rocker arm and hydraulic lifter respectively. Therefore the technician working on the rocker arms can only extract the pushrods by moving the rocker arm assembly off of the cylinder head of the engine.

Therefore, there is a need to efficiently perform valve train services including cam removal and/or replacement, hydraulic lifter repair or replacement, and pushrod inspection and replacement and pushrod cover 0-ring replacement.

Because the typical pushrods are of one piece construction, they cannot be removed from the pushrod inspection tube covering. Removal of the rocker arm assembly also requires removal of gaskets and seals which further complicate repair.

Therefore, there is a long felt need for an adjustable length pushrod which can be shortened in size from the top and bottom for removal of the pushrod from the engine within the pre-existing open space between the bottom of the cylinder head and the top of the tappet block of the Evolution® type motorcycle engine.

Various patents have been developed wherein a steel ball is threadably connected to the top of a pushrod for small, minute adjustments of the top of the pushrod within the rocker arm. Inventions pertaining to internal combustion engines in general have been described in U.S. Pat. Nos. 1,118,686; 1,261,632; 1,378,111; 1,464,082; 2,053,743; 2,970,585; and 3,908,615. Although some of these patents provide for adjustability of the top of the pushrod with the ball at the top, these adjustments are for minute little adjustments after the cylinder head and rocker box assembly have been completely disassembled, which ordinarily takes about three hours labor plus tedious replacement of seals and gaskets. Therefore, there is a long felt need for a pushrod which can adjust in size and for easy and efficient removal within the open space between the bottom of the cylinder head of the engine and the top of the tappet block of the Evolution® type motorcycle engine.

SUMMARY OF THE INVENTION

Accordingly, it is an object of the present invention to provide a pushrod which is an improvement over existing pushrods.

More particularly, it is an object of the invention to provide a pushrod which can be easily removed from a Harley Davidson Evolution® type internal combustion engine without disassembling the engine.

It is a further object of the present invention to provide a pushrod which permits adjustments.

It is a further object of the invention to provide a pushrod which can be extendably lengthened to restore the pushrod to its original size within the rocker arm assembly and tappet block of the motorcycle engine.

In keeping with these objects and with others which will become apparent hereinafter, one feature of the present invention resides, briefly stated, in a pushrod which has a stationary mid portion, a top portion movable upwardly and downwardly relative to the stationary support, a bottom portion movable upwardly and downwardly relative to the stationary support and means for retaining the structural integrity of the pushrod in place.

When the pushrod is designed in accordance with the present invention, the length can be adjusted so that the pushrod can be extracted from within the rocker box assembly and the tappet block and removed in the space between the bottom of the cylinder head and the top of the tappet block. A threadable means within the stationary mid support section connects the top portion of the pushrod to the stationary mid support section. Likewise, the bottom portion is threadably engageable with the stationary support in a similar fashion.

In accordance with another feature of the present invention, the stationary support is axially aligned with the top portion and bottom portion so as to create a structurally sound adjustable pushrod with the same structural integrity as a conventional single piece pushrod.

The novel features which are considered as characteristic for the invention are set forth in particular in the appended claims. The invention itself, however, both as to its construction and method of operation, together with additional objects and advantages thereof, will best be understood from the following description of specific embodiments when read in connection with the accompanying drawings.

DESCRIPTION OF THE PREFERRED EMBODIMENT

Figure 1:
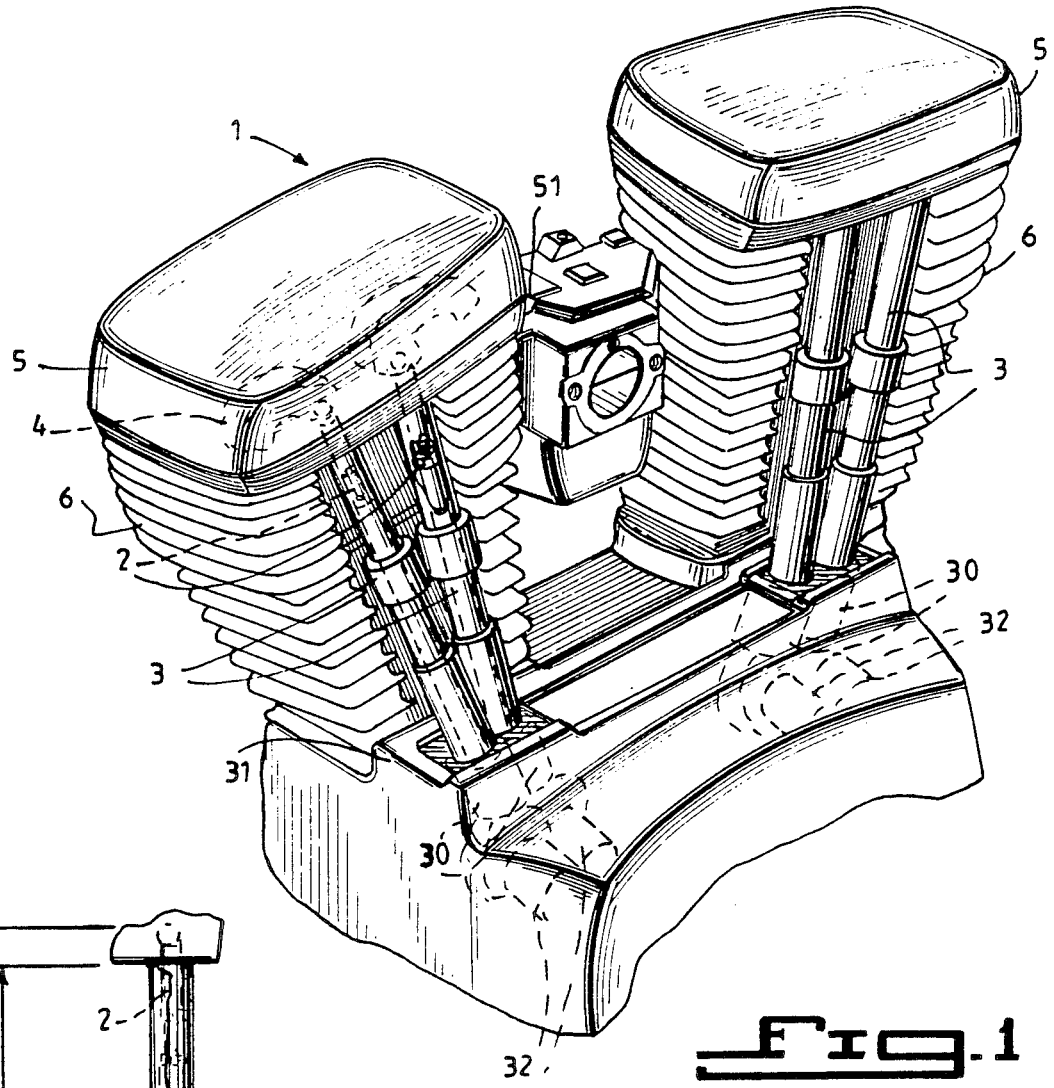
FIG. 1 is a perspective view of the invention shown in place in a motorcycle engine.
Figure 2:
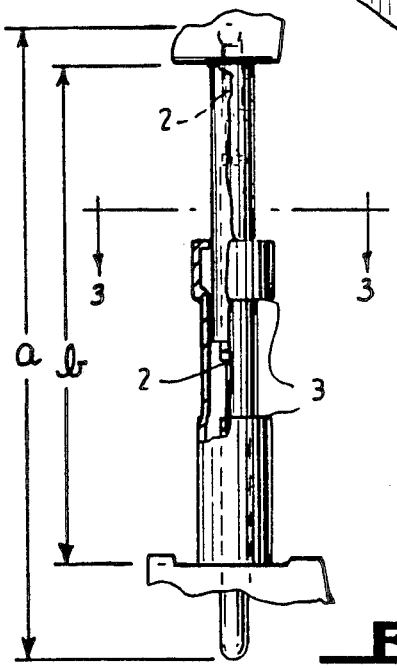
FIG. 2 is a side view of the device showing the longer and shorter length of the device.
Figure 3:
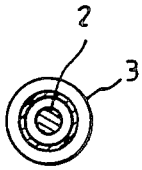
FIG. 3 is a cross sectional view of the device.

A pushrod according to the present invention is installed within a Evolution® type motorcycle 1. The pushrod 2 is situated within snapout pushrod cover 3. The top of the pushrod is movably connected to the rocker arm 4 within the rocker arm cover 5 which is located on the top part of the cylinder head 6.

According to the invention the typical pushrod 2 has a stationary support section 21 including top and bottom threadable extensions 23*a* and 23*b* which are respectively engageable within top ferrule sleeve 24*a* and lower ferrule sleeve 24*b*. The ferrule sleeve 24*a* has a hollow portion 25*a* into which is threadably engaged to the threadable extension 23*a* of stationary support 21. A similar threadable extension 23*b* is threadably engageable within the lower ferrule sleeve portion 24*b* having hollow section 25*b*. The pushrod 2 at its spherical top portion 26 is slidably engageable with the rocker arm 4. The rounded lower end 27 of the lower ferrule sleeve portion 24*b* is engageable with and receives power transmitted from the top of the hydraulic lifter 30 within the tappet block 31, which hydraulic lifter 30 receives mechanical power from the camshaft 32 and drive shaft of the motorcycle engine.

Upper nut 28*a* and lower nut 28*b* are threadably secured between upper ferrule sleeve portion 24*a* and stationary support 21 as well as lower portion 24*b* and stationary support 21. It is noted that the entire pushrod is hollow to allow for the flow of oil therethrough.

Typically in place, the pushrod is concealed at its upper end within the rocker arm cover 5 and its lower end within the tappet block 31. In order to remove the pushrod in a conventionally engine as noted before, the entire rocker arm assembly including rocker arm cover 5 and rocker arm 4 must be disassembled as well as a number of seals and gaskets removed, requiring an exhaustive multi-hour mechanical operation.

Figure 4:
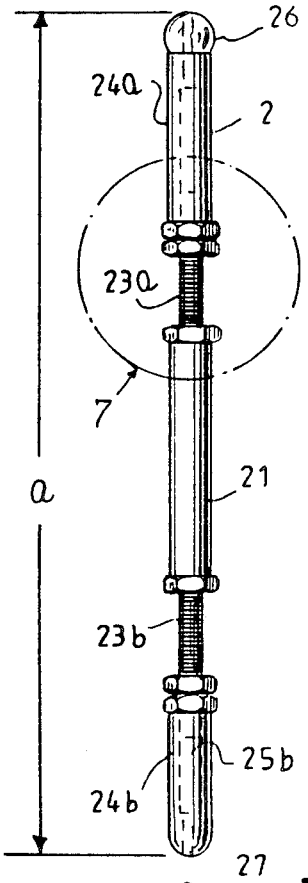
FIG. 4 is a side view of the device in the lengthened position.
Figure 5:
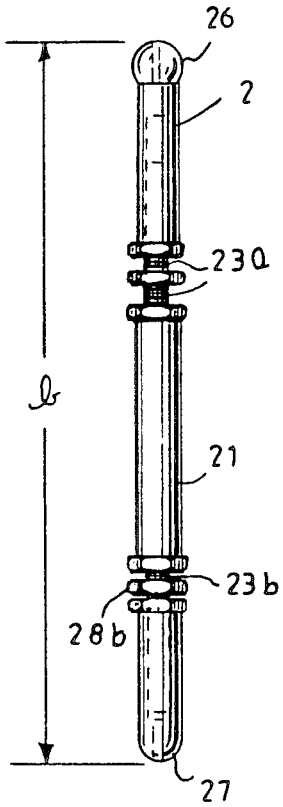
FIG. 5 is a view of the device in the shortened position.
Figure 6:
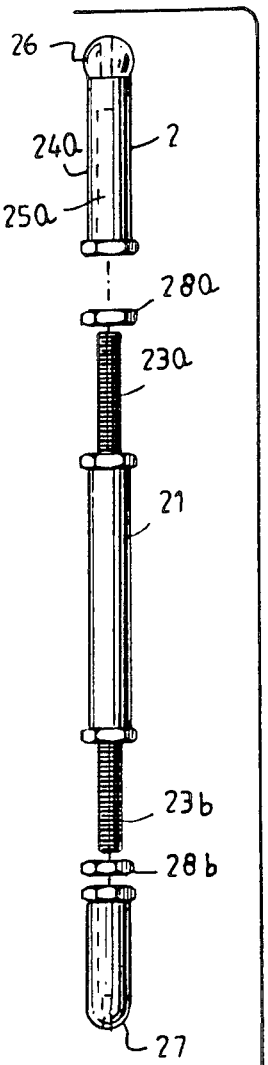
FIG. 6 is a view of the invention in an exploded side view.
Figure 7:
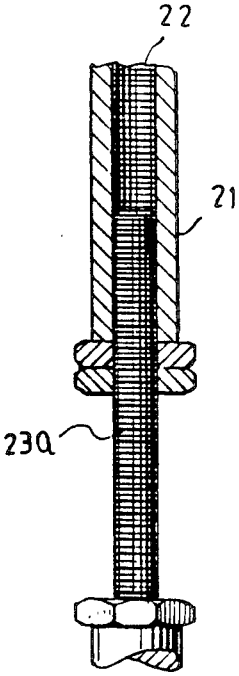
FIG. 7 is a close up view of the device as shown in FIG. 4.

Since the pushrod is a frequently maintained portion of the engine, it is desirable to be able to remove it without disassembling the entire upper portion of the engine including the rocker box assembly. Therefore, the pushrod can be shortened from its operational longer lengths "a" as shown in FIG. 4, to a compressed shorter version "b" as shown in FIG. 5.

This lengthening and shortening is accomplished by threadably rotating in a loosening fashion the upper ferrule sleeve portion 24*a* about threadable extension 23*a*, which extension 23*a* is threadable within the hollow portion 25*a* of upper ferrule sleeve portion 24*a* of the rocker arm 2. Likewise the lower ferrule sleeve portion 24*b* is threadably rotated in a loosening fashion about lower threadable extension 23*b*, which extension 23*b* is threadable within the hollow portion 25*b* of lower ferrule sleeve portion 24*b*, thereby shortening the length of the pushrod from "a" to "b" as shown in FIGS. 4 and 5.

It is noted that the threadable extension 23*a* is fixably engageable within hollow portion 25*a* of ferrule sleeve portion 24*a* so as to form a firm structural fit so that the adjustable rod has the same structural integrity as a unilength conventional pushrod. The opposite lower threadable extension 23*b* is also fixably held within the lower hollow portion 25*b* with the same structural integrity as a unilength singular conventional pushrod.

The pushrod is provided with nuts 28*a* and 28*b* respectively to further improve the structural integrity of the pushrod.

When the pushrod is adjusted from the long length "a" to the short length "b" the pushrod is now small enough to be removed from the space defined from the bottom of the rocker arm assembly at the top of the cylinder head 6 extending below to the top portion of tappet block 31. Therefore the pushrod 2 can be adjusted in size so that it can be easily removed and repaired and/or maintained swiftly and with the minimal expenditure of parts and labor. By placing the pushrod in a smaller position to that of the lengthened position, the invention permits the user to perform rapid removal of the pushrod, with freedom of movement.

It is obvious to one skilled in the field that this invention can be used as a removable, adjustable pushrod with the same structural integrity as a conventional one.

It is also obvious that the pushrod can be locked in place by threadably engaging the top and bottom ferrule sleeve portions with the central stationary support section.

It is to be understood that the form of the invention herein shown and described is to be taken as a preferred example of same and that various changes in the shape, size and arrangement of parts may be resorted to without departing from the spirit of the invention.

I claim:

1. A removable, adjustable pushrod for use within an Evolution® type motorcycle engine wherein the pushrod is engageable at its top end with a rocker arm and its lower end with a hydraulic lifter within the teappet block, the invention comprising; a hollow stationary support section having respective lengthwise extendable upper and lower threadable extensions for engagement with said rocker arm and said hydraulic lifter respectively and means for adjusting the length thereof of said pushrod; said upper and lower threadable extensions extend axially at opposite ends of the said stationary support, said threadable extensions engageable within opposite pairs of hollow ferrule sleeve portions engageable at each end of said stationary support, for threadably engaging said threadable extensions within said hollow portions for adjusting the length of said pushrod.

2. The invention as defined in claim 1 further comprising means for supporting said threadable portions to said central support, said supporting means including at least one threadable nut threadable over said threadable portion between said upper portion and said central stationary support section, and a second supporting means including a threadable portion engageable between said lower extension and said stationary support.

3. The invention as defined in claim 2 further comprising an upper spherical end rocker arm engageable portion and a lower rounded hydraulic lifter engageable portion for engaging said pushrod with said rocker arm and said hydraulic lifter.

* * * * *